US008985407B2

(12) United States Patent
Mack

(10) Patent No.: US 8,985,407 B2
(45) Date of Patent: Mar. 24, 2015

(54) ONE-PIECE DISPENSING CAP FOR A CONTAINER

(75) Inventor: Dustin John Mack, St. Francis, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/413,357

(22) Filed: Mar. 6, 2012

(65) Prior Publication Data

US 2013/0233897 A1 Sep. 12, 2013

(51) Int. Cl.
*A47G 19/24* (2006.01)
*B65D 47/00* (2006.01)

(52) U.S. Cl.
CPC ..... *A47G 19/24* (2013.01)
USPC ..... 222/565; 222/556

(58) Field of Classification Search
USPC ..... 222/565, 556
See application file for complete search history.

(56) References Cited

U.S. PATENT DOCUMENTS

| | | | | |
|---|---|---|---|---|
| D352,899 | S | 11/1994 | Molo | |
| 5,509,582 | A | 4/1996 | Robbins | |
| D374,794 | S | 10/1996 | Ahern | |
| 5,632,417 | A | 5/1997 | Robbins et al. | |
| D384,283 | S | 9/1997 | Davies et al. | |
| D386,685 | S | 11/1997 | Miller | |
| D410,388 | S | 6/1999 | Fisher et al. | |
| D411,886 | S | 7/1999 | Manganiello | |
| 6,039,224 | A | 3/2000 | Dallas et al. | |
| D442,086 | S | 5/2001 | Mozes | |
| D443,825 | S | 6/2001 | Goettner | |
| 6,279,788 | B1 | 8/2001 | Lillelund et al. | |
| 6,286,731 | B1 | 9/2001 | Lillelund et al. | |
| 6,691,901 | B2 | 2/2004 | Parve et al. | |
| 7,007,830 | B2 | 3/2006 | Parve et al. | |
| D520,622 | S | 5/2006 | Yamamoto et al. | |
| D548,086 | S | 8/2007 | Conway et al. | |
| D557,988 | S | 12/2007 | Deeds | |
| D557,989 | S | 12/2007 | Deeds | |
| D564,878 | S | 3/2008 | Baughman et al. | |
| D582,273 | S | 12/2008 | Vogel | |
| D607,315 | S | 1/2010 | George et al. | |
| 7,712,638 | B2 | 5/2010 | Kick | |
| D623,064 | S | 9/2010 | Salmon et al. | |
| D625,192 | S | 10/2010 | Kooser et al. | |
| 7,823,736 | B1 | 11/2010 | Pugne et al. | |
| 7,909,212 | B2 * | 3/2011 | Parve | 222/480 |
| D636,673 | S | 4/2011 | Lohrman et al. | |
| 8,066,158 | B2 * | 11/2011 | Vogel et al. | 222/480 |
| 2001/0013527 | A1 * | 8/2001 | Samz et al. | 222/480 |
| 2004/0134942 | A1 * | 7/2004 | Parve et al. | 222/556 |
| 2005/0023304 | A1 * | 2/2005 | Vogel et al. | 222/480 |
| 2006/0186077 | A1 * | 8/2006 | Robinson | 215/237 |
| 2007/0007310 | A1 * | 1/2007 | Antal et al. | 222/480 |
| 2007/0145082 | A1 * | 6/2007 | Parve | 222/480 |
| 2007/0278254 | A1 | 12/2007 | Wisniewski | |
| 2008/0087690 | A1 | 4/2008 | Parve | |
| 2008/0257918 | A1 | 10/2008 | Vogel et al. | |
| 2010/0140304 | A1 | 6/2010 | Walunis et al. | |
| 2010/0213221 | A1 | 8/2010 | Vogel et al. | |
| 2010/0230446 | A1 * | 9/2010 | Daggett | 222/480 |

* cited by examiner

*Primary Examiner* — Paul R Durand
*Assistant Examiner* — Jeremy W Carroll

(57) ABSTRACT

A one-piece dispensing cap includes a sidewall and an upper surface. A lid is hingedly connected to the upper surface and the lid is moveable between open and closed positions. A plurality of dispensing apertures are disposed in the upper surface and a plurality of projections depend from an interior surface of the lid. The plurality of projections mate with the plurality of apertures to seal the cap in the closed position.

20 Claims, 10 Drawing Sheets

ONE-PIECE DISPENSING CAP FOR A CONTAINER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure relates to a one-piece dispensing cap that facilitates dispensing of a product from a container.

2. Description of the Background of the Invention

Hand-held containers for products have been used to dispense powders, pellets, seeds, and other flowable particles. Generally, containers for dispensing products include lids that must be fully removed prior to use. Other dispensing products may include caps having lids that open in some fashion to expose openings in the container that allow the product to be dispensed therethrough. Such lids are typically not retained in the closed position after numerous opening/closing cycles due to fatigue, friction and/or strain on the lid. Further, other problems may occur during the manufacturing process of multiple component lids, whereby components of the lid may be offset from one another such that the lid does not properly close.

The aforementioned problems are addressed by the cap disclosed in the present application. For example, a hinged lid that is integrally attached to the cap reduces the number of parts needed during the manufacturing process. In addition, the one-piece nature of the cap reduces cost and increases the precision of the molding during the manufacturing process. For example, the projections on the lid are molded in line with the apertures on the dispensing surface and aligned such that the lid closes properly and securely. Further, various locking mechanisms, such as the snap feature disclosed herein, assist in releasably attaching the lid to the dispensing surface in a secure manner such that product is unable to escape inadvertently when the cap is not in use. Still further, the presently disclosed caps provide greater stiffness to the hinge and reduce flexing and bowing in the opening and closing process.

SUMMARY OF THE INVENTION

According to one embodiment of the present invention, a one-piece dispensing cap includes a sidewall and an upper surface. A lid is hingedly connected to the upper surface and the lid is moveable between open and closed positions. A plurality of dispensing apertures are disposed in the upper surface and a plurality of projections depend from an interior surface of the lid. The plurality of projections mate with the plurality of apertures to seal the cap in the closed position.

According to another embodiment of the present invention, a one-piece dispensing cap includes a sidewall and an upper surface. A lid extends from a portion of the upper surface. The lid is hingedly connected to the upper surface and moveable between open and closed positions. A raised edge extends around a portion of a perimeter of the annular wall. The lid and the raised edge of the sidewall interact to seal the cap in the closed position.

According to yet another embodiment of the present invention, a one-piece dispensing cap includes an annular wall and an upper surface comprising a dispensing area and a closed area. A lid extends from a portion of the upper surface. The lid is hingedly connected to the upper surface and moveable between open and closed positions. At least one protrusion extends from an interior surface of the lid and is adapted to interact with at least one aperture disposed in the upper surface in the closed position.

Other aspects and advantages of the present invention will become apparent upon consideration of the following detailed description and the attached drawings, in which like elements are assigned like reference numerals.

DETAILED DESCRIPTION OF THE DRAWINGS

Figure 9:
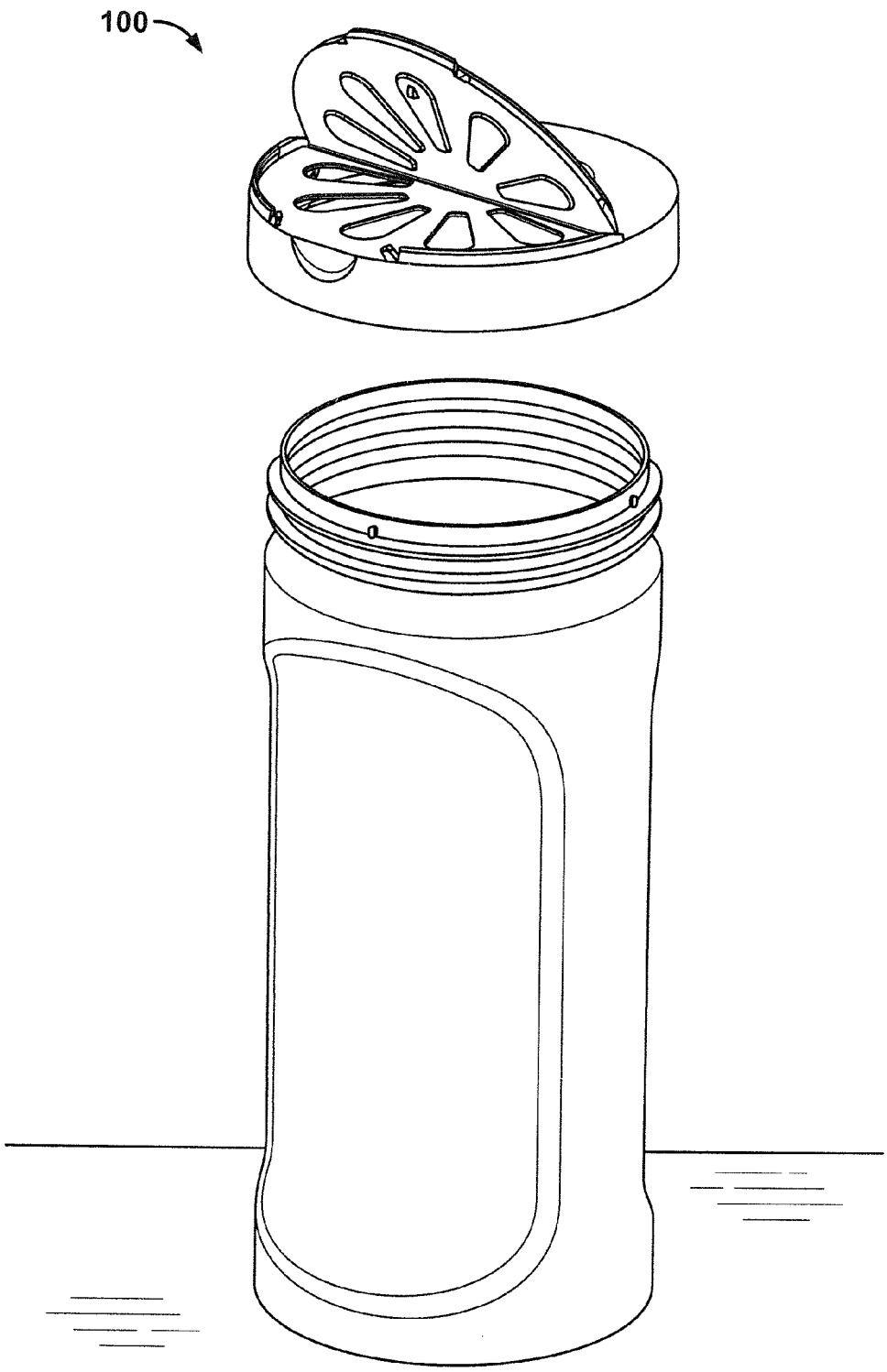
FIG. 9 is an exploded isometric view of the cap of FIG. 1 with a first container.
Figure 10:
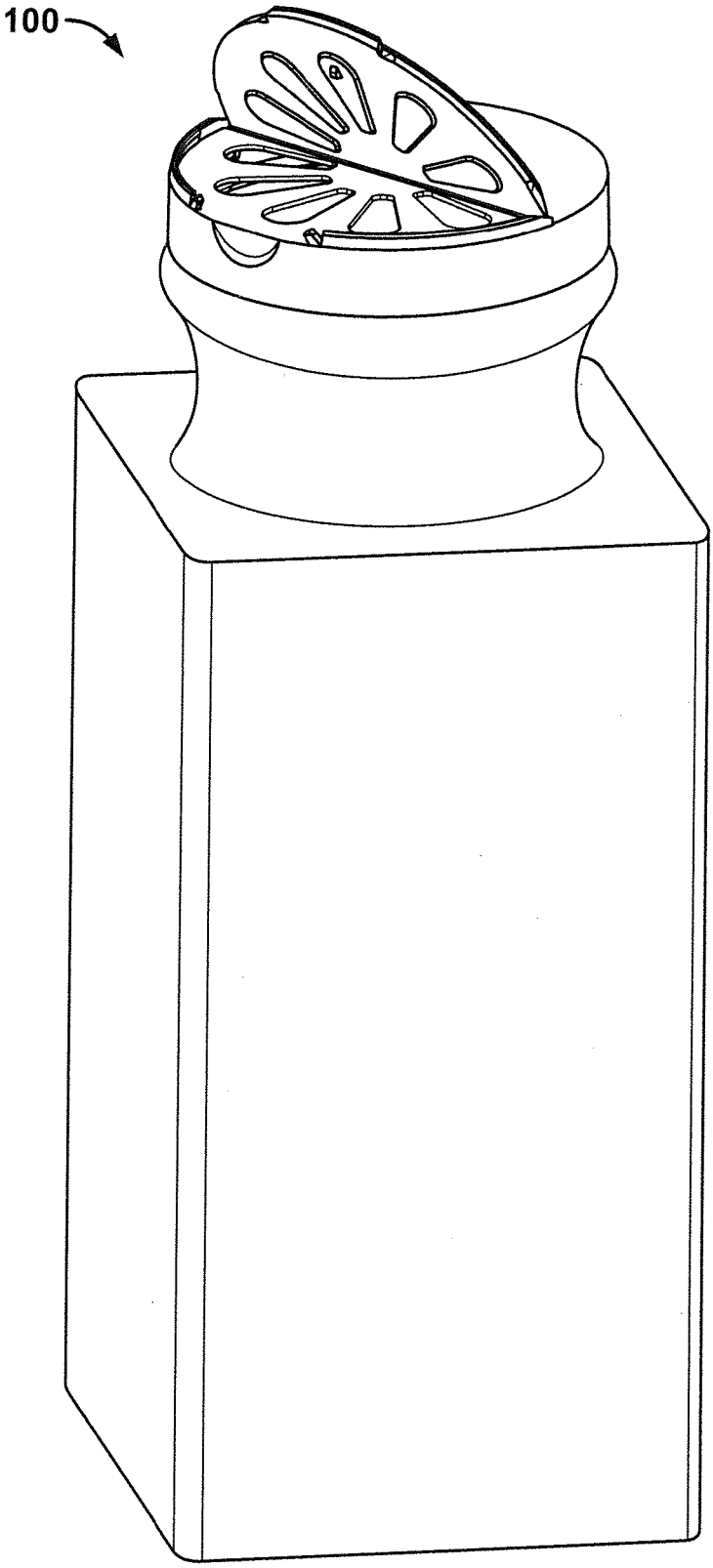
FIG. 10 is an isometric view of the cap of FIG. 1 on a second container.

FIGS. 1-8 depict a one-piece dispensing cap 100 adapted for use with a container (see, for example, FIGS. 9 and 10). The container is adapted to hold and release product (not shown) contained therein. The cap 100 comprises a base or sidewall 102, which in the present embodiment is cylindrical in shape. However, it is contemplated that the base or sidewall 102 may comprise any number of geometric configurations, including a square, rectangle, oval, etc.

The sidewall 102 terminates at a substantially flat upper surface 104, which is adapted to be releasably sealed by a lid 106 that extends therefrom. The upper surface 104 is bifurcated into a dispensing area 108 and a closed area 110 by a hinge 112 that extends across and is integral with the upper surface 104. The dispensing area 108 comprises approximately 50% of the total surface area of the upper surface 104. In other embodiments the dispensing area 108 comprises more than 50% of the upper surface area 108, e.g., from about 51% to about 80%, or less than 50% of the total surface area of the upper surface 108, e.g., from about 20% to about 49%. The dispensing area 108 is adapted to be covered when the lid 106 is in the closed, non-dispensing position (see FIG. 7). The dispensing area 108 is exposed when the lid 106 is in an open, dispensing position (see FIG. 6).

Figure 1:
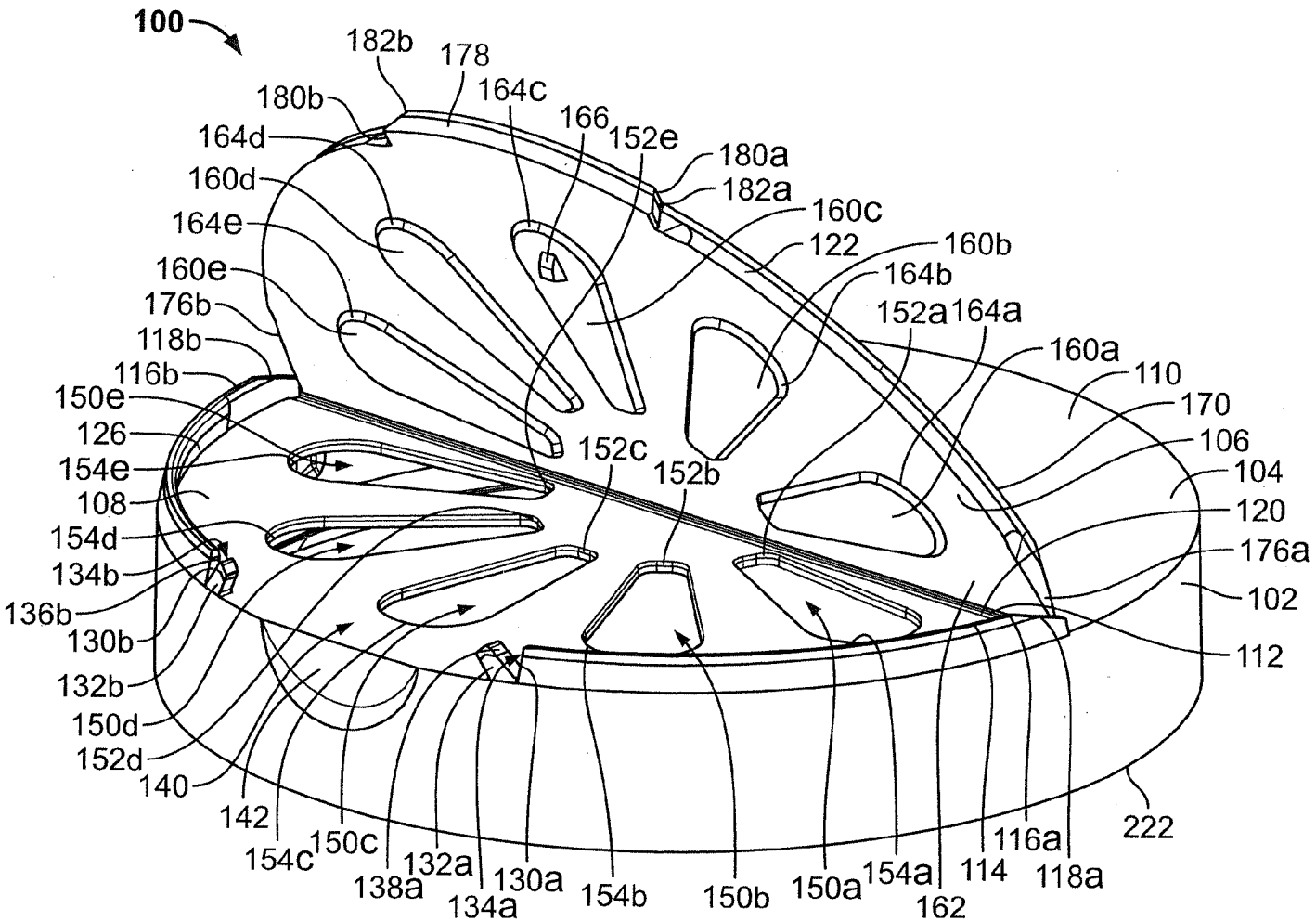
FIG. 1 is an isometric view of a top, front, and side of a cap.
Figure 2:
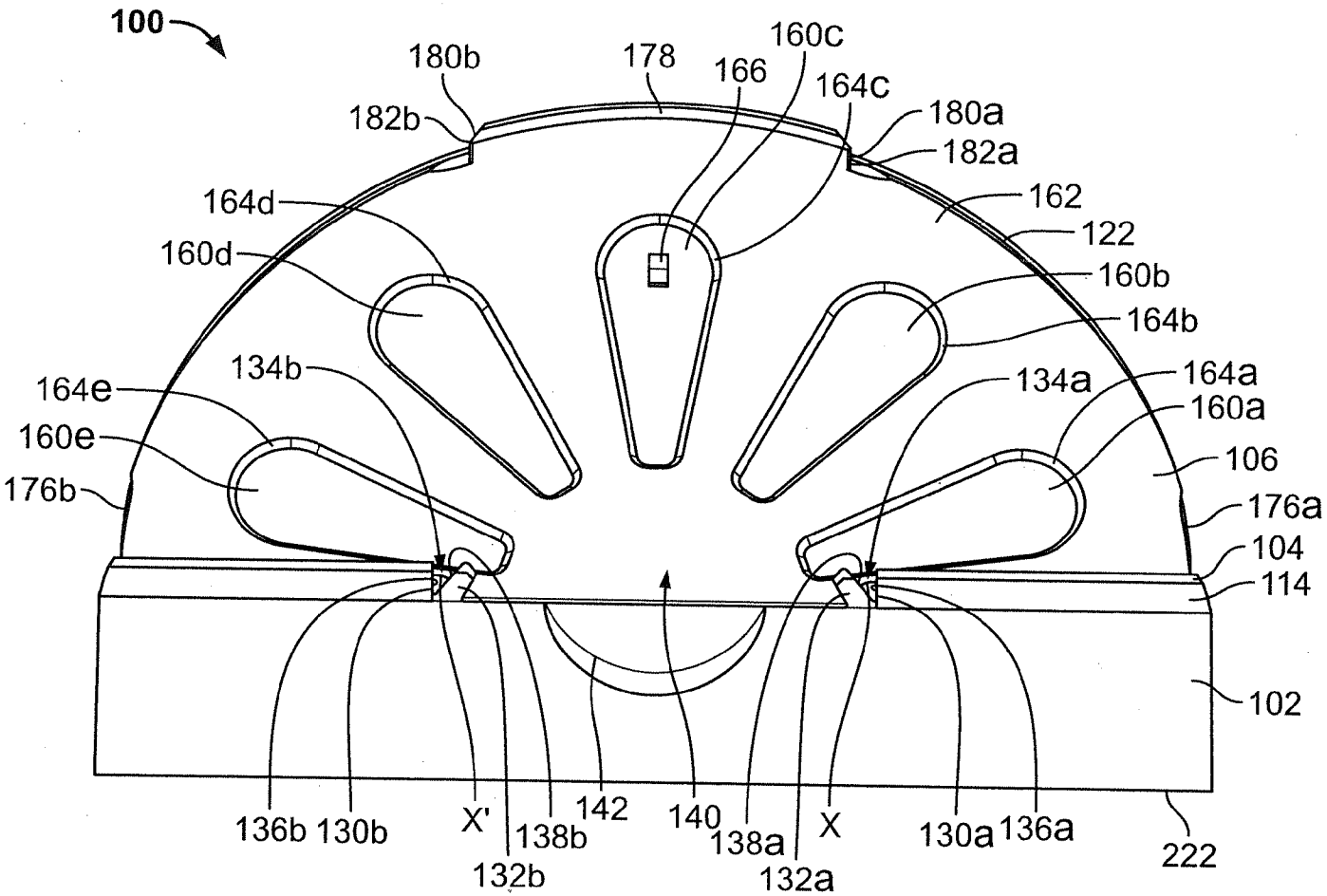
FIG. 2 is a front elevational view of the cap of FIG. 1.
Figure 3:
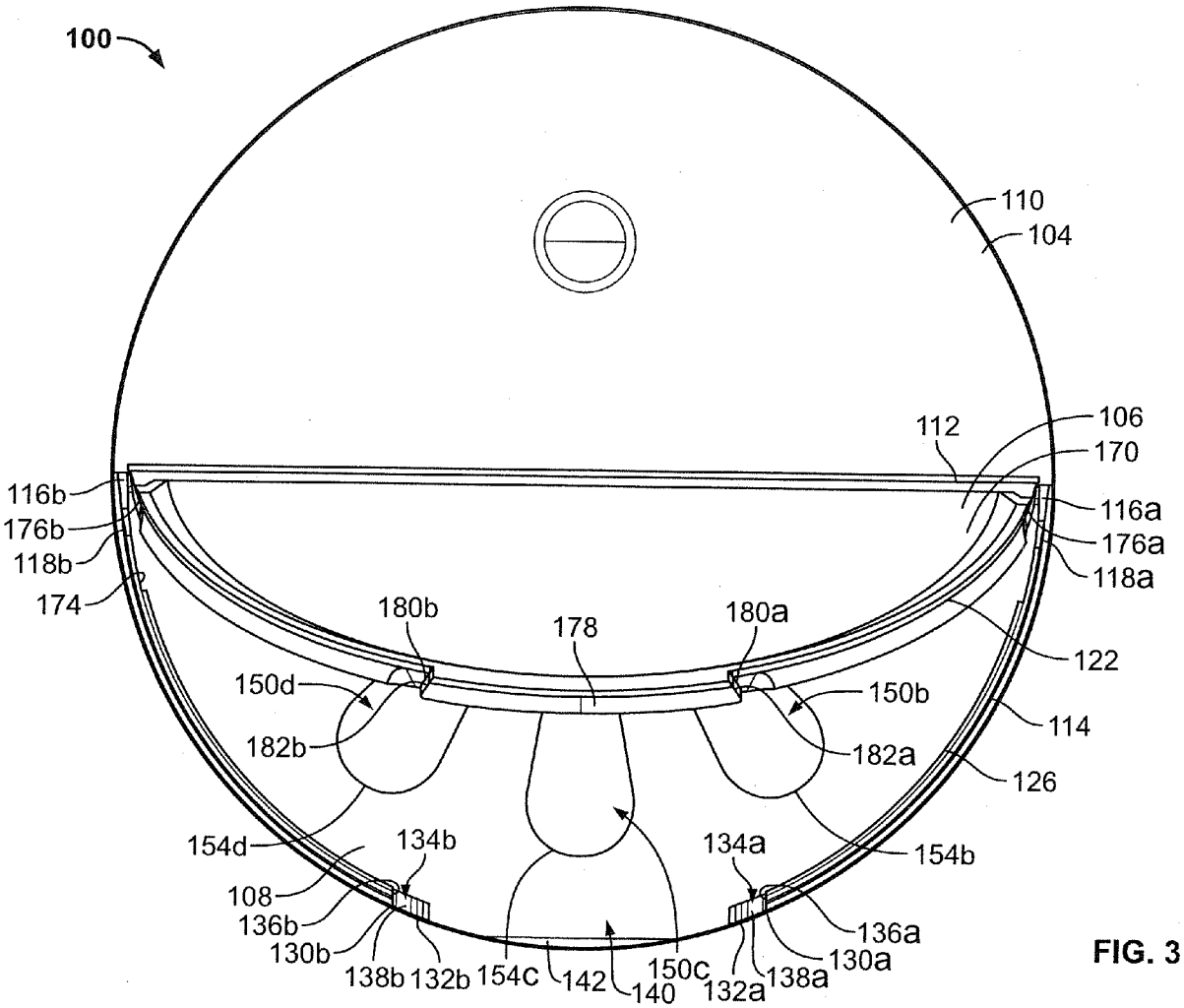
FIG. 3 is a top plan view of the cap of FIG. 1.

As best seen in FIGS. 1-3, the dispensing area 108 includes a raised edge 114 extending around a periphery thereof. The raised edge 114 extends upwardly from the dispensing area 108 and terminates at a rounded top. At first ends 116*a*, 116*b*, the raised edge 114 terminates with inclined surfaces 118*a*,

118*b* disposed adjacent the hinge 112. The inclined surfaces 118*a*, 118*b* preferably include an incline angle of about 90 to about 180 degrees. The inclined surfaces 118*a*, 118*b* preferably correspond to portions of the lid 106 to facilitate the lid 106 closing process.

The hinge 112 is preferably a living hinge that extends across the upper surface 104 and acts as an attachment point for the lid 106. The hinge 112 is preferably extruded with the cap 100 during the manufacturing process such that the lid 106, hinge 112, and cap 100 all comprise an integral component. In other embodiments, other types of hinges may be used as is known in the art.

As best seen in FIG. 1, a space is provided in the form of a trough 120 that is adjacent the hinge 112. In the present embodiment a length dimension of the trough is parallel to the hinge 112. The trough 120 is preferably spaced between about 0.01 cm to about 0.05 cm, more preferably spaced between about 0.02 cm to about 0.04 cm, and most preferably spaced about 0.025 cm in front of the hinge 112. Preferably, the trough 120 is provided in the dispensing area 108. In the embodiment shown, the trough 120 extends across the entire dispensing area 108 and includes a length dimension of about 7 cm to about 7.5 cm. In other embodiments, the trough 120 extends only partially across the dispensing area 108. In the embodiment of FIG. 1, the trough 120 includes a length dimension of about 7.3 cm and a width dimension of about 0.2 cm. The trough 120 is about 0.06 cm deep. The trough 120 provides increased flexibility to the hinge 112 because of the one piece design of the dispensing cap 100 and allows the hinge 112 to sit flush with the dispensing area 108 of the cap 100. Further, the trough 120 reduces the potential for binding of the hinge 112 during the closing process and allows for the hinge 112 to "relax" and lay flat as opposed to warping when the lid 106 is in the closed position.

Still referring to FIG. 1, the inclined surfaces 118*a*, 118*b* are adapted to interact with corresponding portions on the lid 106. The trough 120, in conjunction with the inclined surfaces 118*a*, 118*b*, provides the unique advantage of allowing the hinge 112 increased flexibility during the closing process. In particular, the lid 106 is able to freely rotate into the closed position substantially unimpeded because the lid 106 does not abut the raised edge 114 in an area adjacent the lid 106 attachment point at the hinge 112. A further advantage to the present cap 100 is the creation of a substantially flat upper surface 104 when the lid 106 is in a closed position, as the trough 120 and inclined surfaces 118*a*, 118*b* allow the lid 106 to lay flat on the upper surface 104 within the raised edge 114. Still further, the raised edge 114 may also include the added advantage of strengthening the dispensing cap 100.

Figure 8:
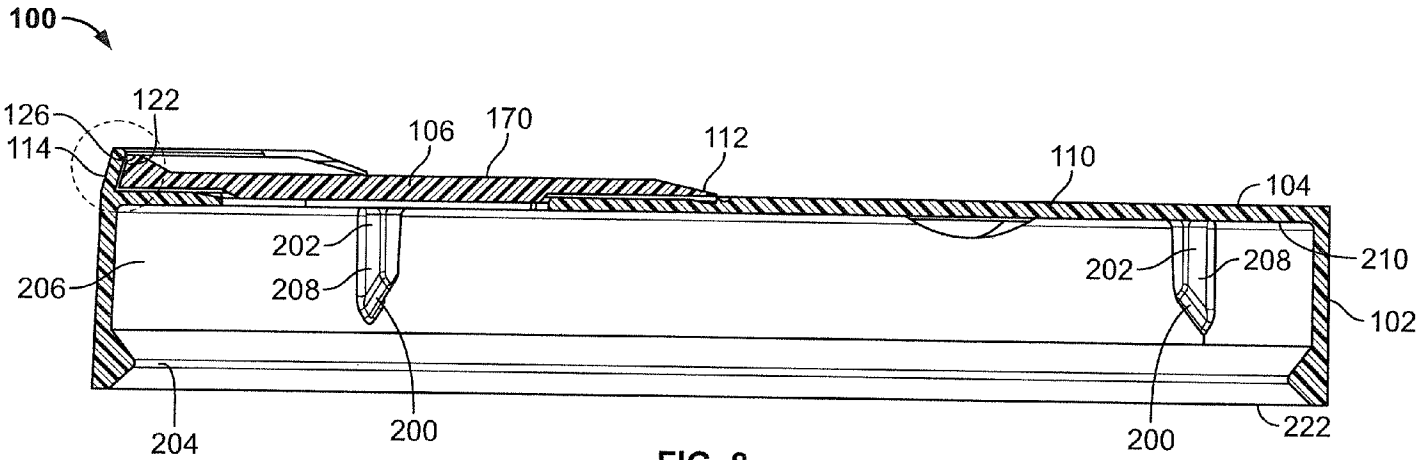
FIG. 8 is a cross-sectional view of the cap of FIG. 7 taken along the line 8-8 of FIG. 7.
Figure 8A:
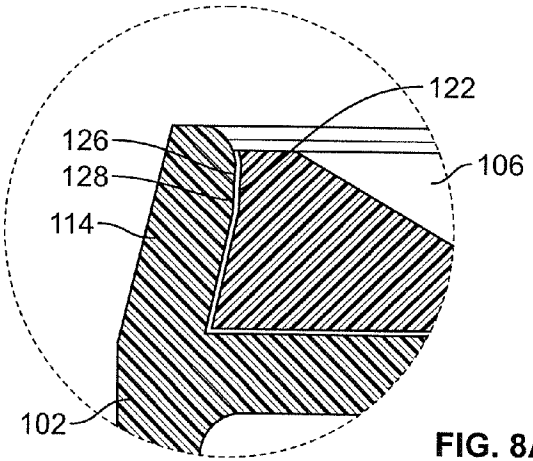
FIG. 8A is an enlarged partial sectional view of the cap of FIG. 8.

A releasable locking mechanism may be included on portions of the lid 106 adjacent the hinge 112. In one embodiment, the releasable locking mechanism is provided in the form of a snap comprising a rounded sidewall 122 or periphery of the lid 106 (see FIGS. 8 and 8A). While shown as rounded in the present embodiment, it is also contemplated that other geometric shapes may be used to define the perimeter or periphery of the lid 106 to effect the same results. The rounded sidewall 122 is adapted to interact with an undercut 126 disposed on an interior surface 128 of the raised edge 114 to assist in retaining the lid 106 in the closed position. The rounded sidewall 122 and undercut 126 also assist in eliminating dusting, which occurs when product is unintentionally released through caps during non-use when lids are in the closed position. Further, the rounded sidewall 122 and undercut 126 interaction increases the opening and closure force of the lid 106, which assists in creating a tight seal such that inadvertent opening of the lid 106 is prevented. In other embodiments, other releasable locking mechanisms may be used as is known in the art.

As best seen in FIGS. 1 and 2, the raised edge 114 terminates at second ends 130*a*, 130*b*. Angled projections 132*a*, 132*b* are disposed adjacent the second ends 130*a*, 130*b* and extend outwardly therefrom, respectively, to assist in releasably locking the lid 106 to the dispensing surface 104, as will be explained in more detail hereinbelow. V-shaped notches 134*a*, 134*b* are formed by surfaces 136*a*, 136*b* of the second ends 130*a*, 130*b* and surfaces 138*a*, 138*b* of the angled projections 132*a*, 132*b*. Preferably, the V-shaped notches 134*a*, 134*b* are defined by an opening having angles X, X', shown in FIG. 2, which are from about 20 degrees to about 80 degrees, and more preferably from about 30 degrees to about 65 degrees, and most preferably about 50 degrees. In another embodiment, the notches 134*a*, 134*b* include openings having angles X, X' that are obtuse. In still a further example, the notches 134*a*, 134*b* include openings having rounded surfaces. In a different embodiment, the notches 134*a*, 134*b* and corresponding parts on the lid 106 may be provided in other shapes and sizes such as rectangular, square, oval, and trapezoidal that assist in retaining the lid 106 in a closed position. In yet another embodiment, the hinged lid 106 may include the notches 134*a*, 134*b* to interact with corresponding portions of the base 102 to seal the lid 106 to the dispensing surface 104.

A gap 140 is provided between the projections 132*a*, 132*b*, which is adapted to retain an extending portion of the lid 106 when the lid 106 is in a sealed position. As shown in the embodiments in FIGS. 1-7, the gap 140 is preferably between about 1 cm to about 5 cm, more preferably between about 1.5 cm to about 3 cm, and most preferably about 2 cm. In other embodiments, the gap 140 may be larger or smaller to correspond to the sizing of portions of the lid 106 that are adapted to be releaseably retained therein.

Still referring to FIGS. 1-7, a semi-circular cutout 142 is disposed in the sidewall 102 of the cap 100 below the gap 140. The cutout 142 preferably corresponds to the shape of a portion of a user's finger to assist the user in closing and opening the lid 106 as will be explained in more detail below. In other embodiments, the cutout 142 may be provided in other shapes and sizes to accommodate different finger sizes or may be omitted all together.

Figure 5:
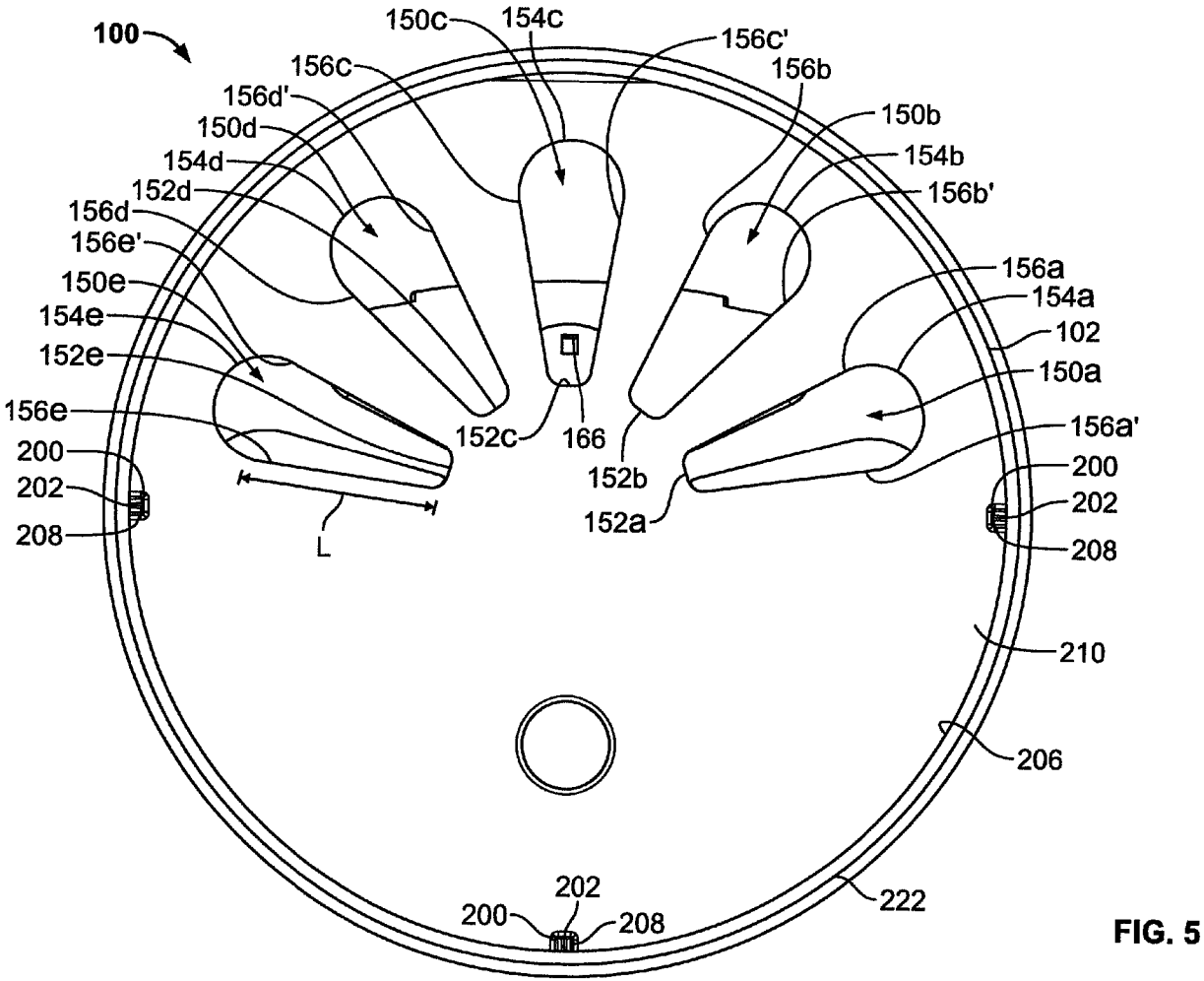
FIG. 5 is bottom elevational view of the cap of FIG. 1.

Now referring to FIGS. 1 and 5, a plurality of apertures 150 are shown disposed within the dispensing surface 104 that are spaced interiorly from the raised edge 114. In the present embodiment, the apertures 150 are equidistantly spaced from one another in a radial pattern. In the illustrated embodiment, five apertures 150*a*-150*e* are provided. Each aperture 150 is substantially teardrop shaped and includes a narrowed end portion 152*a*-152*e* and a widened head portion 154*a*-154*e*. As shown in FIG. 5, each aperture 150*a*-150*e* is defined by two side portions 156*a*-156*e*, 156*a*'-156*e*' having a length of about 2.0 cm to about 2.1 cm that connect the end portions 152*a*-152*e* to the head portions 154*a*-154*e*. The lengths of the side portions 156*a*-156*e*, 156*a*'-156*e*' are defined by the distance of the straight line portion of the apertures 150*a*-150*e* (see, e.g., length L in FIG. 5). The narrowed end portions 152*a*-152*e* have a radius of curvature of about 0.2 cm to about 0.3 cm and the widened head portions 154*a*-154*e* have a radius of curvature of about 0.4 cm to about 0.5 cm. In the embodiment depicted, the two side portions 156*a*-156*e*, 156*a*'-156*e*' each have a length of about 1.4 cm. In another embodiment, the apertures 150*a*-150*e* include other straight edges that define a square, rectangle, and the like. In a different embodiment, the apertures 150*a*-150*e* include shapes having a non-straight edge, such as, for example, a circle, an oval, and the like. In still other embodiments, the apertures may be other shapes and sizes as known in the art.

Turning to FIGS. 1 and 2, the apertures 150*a*-150*e* are sized to correspond to a plurality of projections 160 that extend from an interior surface 162 of the lid 106. In the illustrated embodiment, five projections 160*a*-160*e* are provided. Each projection 160*a*-160*e* is defined by a raised surface with a rounded edge 164*a*-164*e* around the periphery thereof that is sized to fit within the apertures 150*a*-150*e*, respectively (see FIG. 8). In one particular embodiment, the sizing of the projections 160*a*-160*e* and apertures 150*a*-150*e* may be modified to provide a snap-fit connection to retain the lid 106 onto the dispensing surface 104. In other embodiments, the projections may be other shapes and sizes as known in the art. Providing the projections 160*a*-160*e* with rounded edges allows the lid 106 to be mated with the dispensing surface 104 in a manner that utilizes less closing force than would otherwise be the case. The rounded edges further assist in preventing misalignment during the closure process.

As best seen in FIG. 2, at least one of the projections 160*c* includes a rounded knot member 166 projecting outwardly therefrom that is adapted to assist in the manufacturing process. In particular, the knot member 166 assists with an extrusion tool being pulled away from the hinge 112 during the molding process. This, in turn, allows for the lid 106 to be closed in line.

Figure 6:
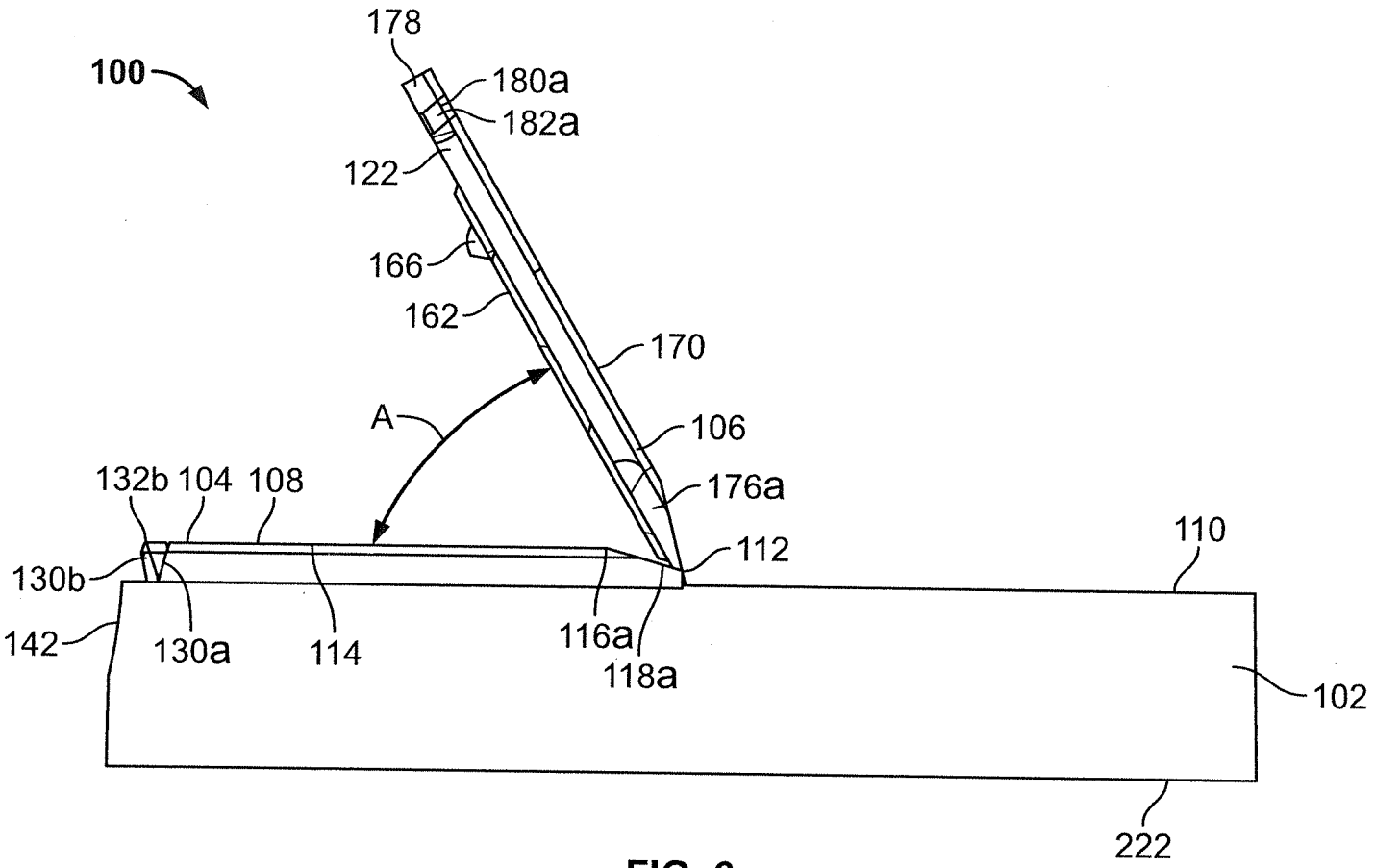
FIG. 6 is a side elevational view of the cap of FIG. 1 in a dispensing position.
Figure 7:
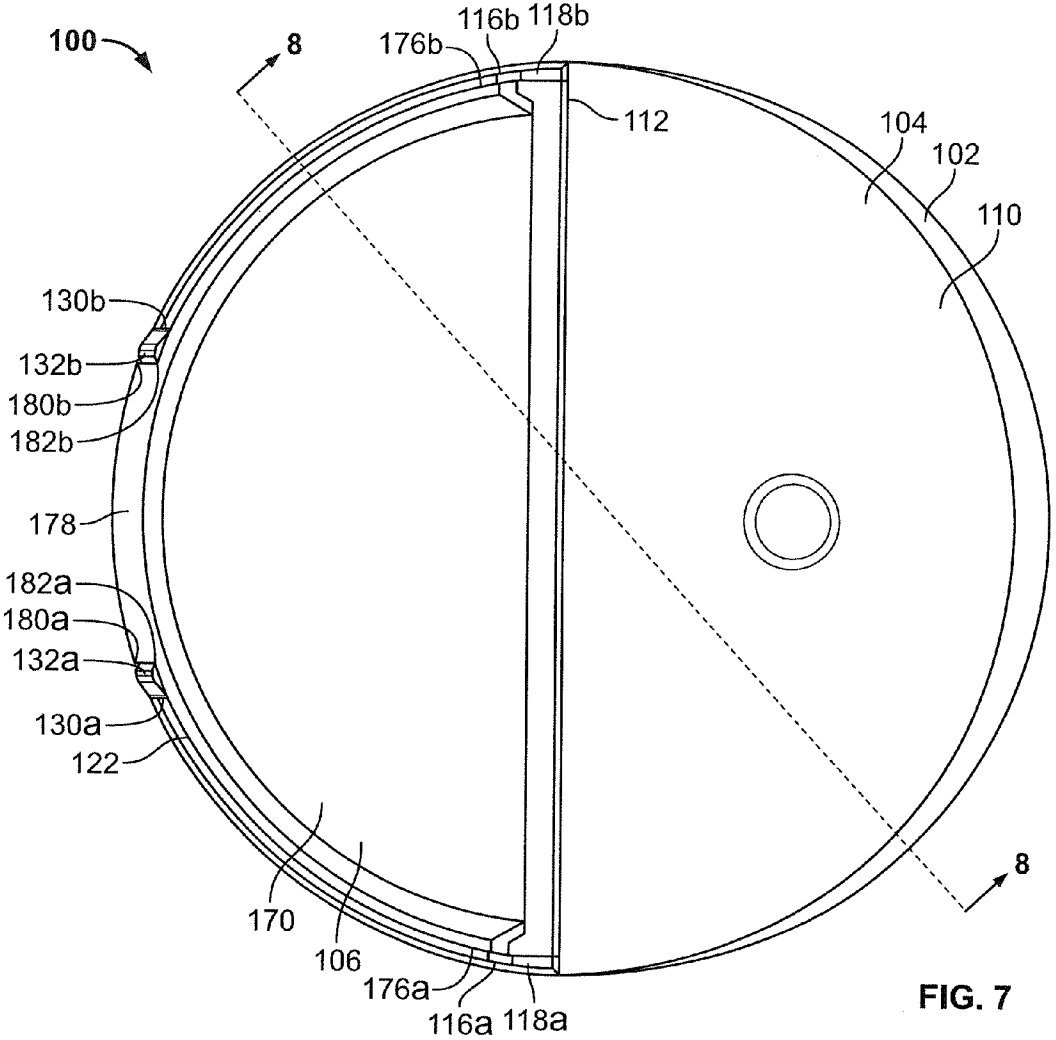
FIG. 7 is a top elevational view of the cap of FIG. 1 in a closed position.

As best seen in FIGS. 3 and 6, the lid 106 is defined by an exterior surface 170 disposed opposite the interior surface 162 by the rounded sidewall 122. The rounded sidewall 122 is adapted to contact the interior surface 128 of the raised edge 114 of the cap 100 to assist in securing the lid 106 thereto (see FIG. 8). Referring again to FIGS. 3 and 6, the rounded sidewall 122 includes thinned areas 176*a*, 176*b* on opposing ends disposed adjacent the inclined surfaces 118*a*, 118*b* of the raised edge 114. The rounded sidewall 122 further includes a rectilinear protrusion 178. In the present embodiment, the rectilinear protrusion 178 is disposed equidistantly between the thinned areas 176*a*, 176*b*. The rectilinear protrusion 178 includes angled surfaces 180*a*, 180*b* at opposing ends 182*a*, 182*b* thereof that are adapted to interact with the angled projections 132*a*, 132*b* that extend from the raised edge 114. The protrusion 178 projects outwardly from the rounded sidewall 122 and is adapted to be grasped by a user during the opening and closing process of the lid 106.

As best seen in FIG. 6, the lid 106 is rotatably attached to the cap 100 via the hinge 112. The lid 106 is adapted to rotate in a manner depicted by arrow A. When the lid 106 is in a closed position, the lid 106 is disposed adjacent the dispensing surface 104 such that the rounded edges 164*a*-164*e* of the projections 160*a*-160*e* are frictionally disposed within the apertures 150*a*-150*e* to create a substantially tight fit such that product (not shown) disposed within the container is unable to escape from the apertures 150*a*-150*e*. At the same time, the rounded sidewall 122 of the lid 106 contacts and rides over the undercut 126 disposed on the interior surface 128 of the raised edge 114.

In use, a user places a finger into the cutout 142 and grasps an underside of the rectilinear protrusion 178 that extends outwardly from the lid 106. As upward force is applied to the rectilinear protrusion 178, the rounded sidewall 122 slides away from the raised edge 114 and rides over the undercut 126 of the raised edge 114. At the same time, the projections 160*a*-160*e* disengage from the apertures 150*a*-150*e*. Further, the slightly angled surfaces 180*a*, 180*b* at opposing ends 182*a*, 182*b* of the rectilinear protrusion 178 ride over and disengage from the angled projections 132*a*, 132*b* that extend from the raised edge 114.

As the user opens the cap 100, the lid 106 rotates about the hinge 112 into a substantially open position (see FIG. 6), which allows product to escape through the apertures 150*a*-150*e* (see FIG. 1). Preferably, the lid 106 is rotatable at an angle of at least about 90 degrees. In a different embodiment, the lid 106 is rotatable from about 1 degree to about 180 degrees. In a still further embodiment, the lid is rotatable more than about 90 degrees and may be releasably secured to the closed area 110 of the cap 100 during a dispensing operation in a manner known in the art to prevent any disruption of product flow.

The cap 100 is used in combination with a container (see FIGS. 9 and 10). Any shaped container may be used so long as the container is able to hold a product. For example, as shown in FIG. 10, the container may include a box-shaped body and a neck portion adapted to receive the cap 100. Prior to use, the cap 100 is attached to a top end of a container. To attach the cap 100 to a container, the cap 100 is positioned above a top end of the container and is pressed downwardly thereover. Many containers known in the art include a crimped portion with an undercut that circumscribes the top end. Preferably, as the cap 100 contacts the crimped portion, the sidewall 102 of the cap 100 flexes outwardly to accommodate the top end of the container. The container and cap 100 are pressed together until the crimped portion of the container is locked between an angled end wall 200 of flanges 202 and a lip 204 of the cap 100 (see FIG. 4).

Figure 4:
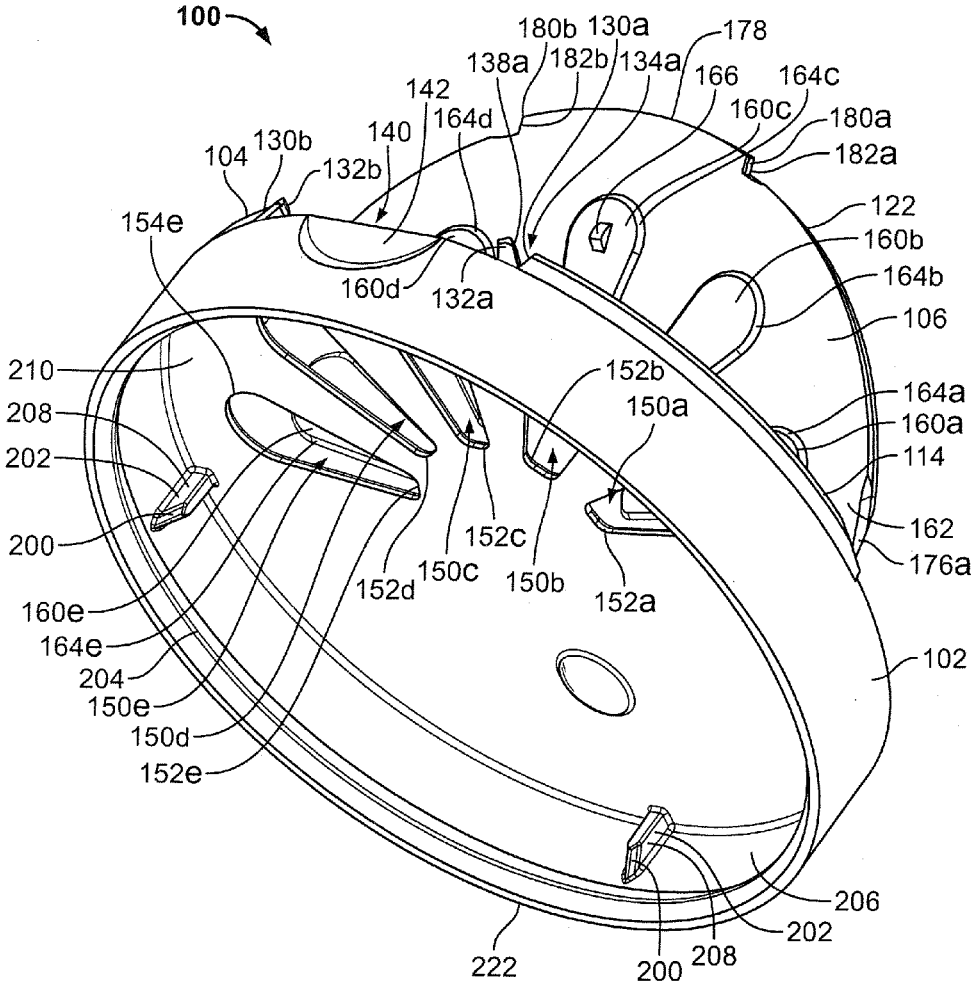
FIG. 4 is a bottom isometric view of the cap of FIG. 1.

As best seen in FIGS. 4 and 5, The flanges 202 are disposed on an interior surface 206 of the sidewall 102 of the cap 100. Each flange 202 includes an elongate body 208 that terminates at and abuts an interior surface 210 of the upper surface 104 of the cap 100. The flanges 202 extend downwardly until terminating at the angled end wall 200. The flanges 202 may prevent or limit rotational movement of the cap 100 when it is disposed on a container. The flanges 202 may also guide the user during the cap attachment process and limit the distance the cap 100 can be pressed downwardly onto a container.

Still referring to FIG. 4, the lip 204 extends outwardly from the interior surface 206 adjacent a lower edge 222 of the cap 100. The lip 204 circumscribes the interior surface 206 and is adapted to flex to accommodate portions of the container when the cap 100 is being attached to the container. The lip 204 is preferably spaced about 1 cm to about 3 cm above the lower edge 222 of the cap 100, and most preferably about 2 cm. In one embodiment, cutouts (not shown) may be provided on various parts of the cap 100 (for example, the lip 204) to allow flexibility in the cap 100. Other attachment mechanisms as known in the art may be used to attach the cap 100 to a container.

The cap 100 may be constructed from any materials known to those skilled in the art. In one embodiment, the cap 100 is constructed from a polymer such as polypropylene. In another embodiment, the cap 100 is constructed of a copolymer and/or of a polymer mixture. One such polymer that may be useful in the present invention is high density polyethylene and the like. The cap 100 and hinge 112 are preferably constructed of materials that allow sufficient flexing to attach and remove the cap 100 from a container. Alternatively, a cap 100 may be provided that is either integral with or fixed to the top end of the container. Still further, other attachment mechanisms may be used to secure the cap 100 to the container.

The cap 100 optionally may include a cover such as a peel seal in the form of a label disposed over either the apertures

150*a*-150*e* and/or the container under the cap 100. The peel seal may be of the type manufactured by Green Bay Packaging, Inc., 3250 South Ridge Road, P.O. Box 19017, Green Bay, Wis. 54307-9017, under the product name Adhesive 275. The presence of the label provides an indication to the user that the container and the contents therein have not been used or tampered with. Prior to initial use, a user removes the label by removing the cap 100 from the container and peeling the label from the container. The user thereafter replaces the cap 100 onto the container. Alternatively, the user opens the lid 106 and removes the label from the apertures 150*a*-150*e*. In a different embodiment, a seal may not be provided, which lowers the manufacturing cost of the cap 100. Additionally, the seal may be omitted for environmental reasons and ease of use for the consumer.

The product disposed within an interior of the container is preferably a flowable substance such as any of those disclosed in U.S. Pat. Nos. 7,407,922 and 7,438,204. However, the product may comprise any type of material that can be disposed within a container. In one embodiment, the flowable solid substance contains an effective amount of one or more odor-counteracting materials. The effective amount of the odor-counteracting material typically includes an amount sufficient to reduce the concentration of an undesirable odor from a textile or other material such that the level of the undesirable odor is reduced in the surrounding environment. In other embodiments, a solid product or powder is provided that may have odor-counteracting properties, deodorizing properties, fragrancing properties, or any other type of property found in a typical household product. In still other embodiments, the product is a solid, liquid, or any other product capable of being dispensed out of a container. It is also envisioned that the present container may include other products not typically found in a household but that have similar flow characteristics as the products discussed herein.

INDUSTRIAL APPLICABILITY

Numerous modifications will be apparent to those skilled in the art in view of the foregoing description. Accordingly, this description is to be construed as illustrative only and is presented for the purpose of enabling those skilled in the art to make and use what is herein disclosed and to teach the best mode of carrying out same. All patents, patent applications, and other references cited herein are incorporated herein by reference as if they appear in this document in their entirety. The exclusive rights to all modifications which come within the scope of this disclosure are reserved.

I claim:

1. A one-piece dispensing cap, comprising:

a sidewall and an upper surface, wherein the sidewall terminates, in part, in a raised edge extending above the upper surface and wherein the sidewall and the raised edge form a smooth, continuous surface;

a lid hingedly connected to the upper surface, wherein the lid is moveable between open and closed positions;

a plurality of dispensing apertures disposed in the upper surface; and a plurality of projections depending from an interior surface of the lid, wherein the plurality of projections mate with the plurality of apertures to seal the cap in the closed position, wherein the lid is configured to separate from the raised edge in the open position and to interact with an interior surface of the raised edge in the closed position, and wherein the dispensing cap is one-piece.

2. The cap of claim 1, wherein the upper surface is bifurcated into a dispensing area and a closed area by the hinge.

3. The cap of claim 2, wherein the dispensing area comprises about 50% of the total area of the upper surface.

4. The cap of claim 2, wherein the raised edge extends around a portion of the dispensing area.

5. The cap of claim 4, wherein the raised edge includes at least one inclined surface.

6. The cap of claim 1, wherein a trough is provided adjacent the hinge and is substantially parallel thereto.

7. The cap of claim 6, wherein the trough is spaced between about 0.01 cm and 0.05 cm from the hinge.

8. The cap of claim 1, wherein the lid is hingedly connected to the upper surface by a living hinge.

9. The cap of claim 1, wherein the plurality of projections frictionally mate with the plurality of apertures to retain the lid in the closed position.

10. A one-piece dispensing cap, comprising:

a sidewall and an upper surface;

a lid extending from a portion of the upper surface, wherein the lid is hingedly connected to the upper surface and moveable between open and closed positions; and a raised edge extending around a portion of a perimeter of the sidewall, wherein the lid interacts only with an interior surface of the raised edge of the sidewall to seal the cap in the closed position.

11. The cap of claim 10, wherein at least one angled projection extends outwardly from an end of the raised edge.

12. The cap of claim 10, wherein two angled projections extend from ends of the raised edge adjacent a gap provided therebetween.

13. The cap of claim 12, wherein the lid includes a rectilinear protrusion for receipt within the gap in a closed position.

14. The cap of claim 13, wherein the rectilinear protrusion includes two angled ends for interaction with the two angled projections of the raised edge.

15. The cap of claim 10, wherein the raised ridge of the sidewall includes an undercut to interact with peripheral portions of the lid in the closed position.

16. A one-piece dispensing cap, comprising:

an annular wall and an upper surface comprising a dispensing area and a closed area;

a raised edge extending upward from a periphery of the dispensing area wherein the annular wall and the raised edge form a smooth, continuous surface;

a lid extending from a portion of the upper surface, wherein the lid is hingedly connected to the upper surface and moveable between open and closed positions; and at least one protrusion extending from an interior surface of the lid adapted to interact with at least one aperture disposed in the upper surface in the closed position, wherein the dispensing cap is one-piece.

17. The cap of claim 16, wherein the cap includes a plurality of apertures disposed in a radial pattern within the upper surface and a plurality of similarly shaped protrusions extending from the lid.

18. The cap of claim 17, wherein the apertures each include a head portion having a radius of curvature of about 0.45 cm and a tail portion having a radius of curvature of about 0.25 cm.

19. The cap of claim 17, wherein the apertures are adapted to receive and frictionally hold the protrusions when the lid is in a closed position.

20. The cap of claim 19, wherein the lid rotates from the open to the closed position about an axis defined by a hinge and the lid is rotatable between about 1 degree to about 180 degrees.

* * * * *